340-566 SR
3/18/86 OR 4,577,184

United States Patent [19]
Hodara et al.

[11] Patent Number: 4,577,184
[45] Date of Patent: Mar. 18, 1986

[54] SECURITY SYSTEM WITH RANDOMLY MODULATED PROBE SIGNAL

[75] Inventors: Henri Hodara, Altadena; Willard H. Wells, Arcadia, both of Calif.

[73] Assignee: Tetra-Tech, Inc., Pasadena, Calif.

[21] Appl. No.: 496,951

[22] Filed: May 23, 1983

[51] Int. Cl.[4] ..... G08B 13/00; G08B 13/18
[52] U.S. Cl. ..... 340/566; 340/531; 340/600
[58] Field of Search ..... 340/566, 600, 531, 533

[56] References Cited

U.S. PATENT DOCUMENTS

| | | | |
|---|---|---|---|
| 3,710,372 | 1/1973 | Andersson et al. | 340/533 |
| 3,938,124 | 2/1976 | Way et al. | 340/531 |
| 4,044,351 | 8/1977 | Everson | 340/533 |
| 4,207,561 | 6/1980 | Steensma | 340/600 |

*Primary Examiner*—Glen R. Swann, III
*Attorney, Agent, or Firm*—Peter I. Lippman

[57] ABSTRACT

This security system monitors a remote intrusion-sensing unit by probing it with a probe signal that is randomly modulated. The intrusion-sensing unit replies with a composite signal in which "secure" or "alarm" status information is superimposed on the random modulation of the probe signal. (The system may if desired be elaborated to accept and utilize other status information, such as "access" or "reverse correlation.")

A master unit checks the correlation of the reply-signal modulation with the probe-signal modulation, and generates a special "deception" alarm if the correlation is not in accordance with an established pattern—such as positive correlation, reverse correlation, or correlation *varying* in some way that is systematic or otherwise determinable by the master unit.

For example, the correlation requirement may be controlled by a code that is generated (even randomly) at the intrusion sensor; or the correlation check may be made insensitive to yet further superimposed variations in signal level, frequency, or delay. Such further variations may, for instance, convey specific information about conditions at the remote secured facility—such as motion, sound or vibration there.

Preferably the signals in both directions are optical signals transmitted by optic fibers. To make deception as difficult as possible (at least in the context of field operations) even for an intruder who knows exactly how the system works, the probe signal is of very low amplitude and the reply signal of very high amplitude.

8 Claims, 5 Drawing Figures

SECURITY SYSTEM WITH RANDOMLY MODULATED PROBE SIGNAL

BACKGROUND

1. Field of the Invention

This invention relates generally to alarm systems for facilities (or equipment) whose security is to be monitored, and more particularly to systems in which monitoring is carried out by automatic equipment that is not in the same location as the secured facility.

2. Prior Art

Conventional intrusion-alarm systems have wires that run from a power or signal source through intrusion sensors to a control unit that monitors the status of the sensors. The simplest intrusion sensors have only two states, "alarm" and "secure," indicated by a switch that is open or closed (usually respectively). The most familiar example is the magnetic switch used on doors and windows with burglar-alarm systems.

One strategy for an intruder who wishes to gain entry is to "deceive" such a system by shorting the wires—or by determining and injecting via a simple electrical splice whatever signal is required to indicate the secure status. The subject facility can then be breached without generating an "alarm" at the monitoring apparatus, even though the condition of the sensor(s) is forced into the "alarm" condition.

This strategy has its analogy for more modern systems in which the signals are optical and are carried on optic fibers: the intruder must (1) know generally how the system works, and
(2) either (a) know which fiber carries the probe signal and which the reply signal, or (b) be prepared to inject the proper optical signal into *both* fibers, and
(3) either (a) know the necessary signal parameters, or (b) determine them by finding and forming a slight defect in the transmission characteristic along one of the fibers, then coupling optical energy out of the fiber at that point, and observing the parameters of that tapped signal, and
(4) formulate or obtain a deception signal that simulates the necessary parameters, and
(5) find or form a slight defect in the transmission characteristic along the reply-signal fiber, and
(6) inject the deception signal via the defect into the fiber.

The equivalent of "shorting" is awkward or impossible because it is hard to construct or form an efficient energy-transmitting tap, along either the probe-signal fiber *or* the reply-signal fiber, without interrupting signal transmission along the fiber at the prospective tap site. Thus an alarm will be generated in the course of trying to effectuate the optical "short." This limitation, however, is not crucial to the efforts of an intruder in prior-art systems because the parameters of the signals used have been determinable by prior knowledge or observation—and in most cases have been fairly simple—and have been relatively easily to simulate. Therefore it has been unnecessary for an intruder to "short" the probe and reply signals. The intruder simply "works around" this requirement by determining and simulating the probe signal.

Because prior systems have been relatively easy to defeat in the ways just described, we have sought to provide a system that renders ineffective the intrusion strategies described above. We have invented a system which effectively precludes alternatives (2)(b) and (3)(a) of the numbered steps in the preceding description, and which makes steps (3)(b) and (6) extremely difficult—and perhaps, under the conditions in which a would-be intruder must normally work, impossible.

Moreover, even if a would-be intruder successfully surmounts the plain difficulties of steps (1), (2)(a), (3)(b), (5), and (6), our invention in its more elaborate forms renders even more difficult the performance of step (4).

BRIEF SUMMARY OF THE INVENTION

Our invention provides a novel alarm system for a facility whose security is to be monitored. By the term "facility" we mean not necessarily an entire building or large land area, but also even a small piece of equipment, a safe, a display case, a small room, or an area within a room.

The system includes a signal source that generates a "probe signal"—that is, an electrical, optical, or other signal (but preferably optical) that is to be directed over at least a short distance from a monitoring station or device to the subject facility.

In addition to the probe-signal source, the system also includes another signal source—a modulating-signal source, whose function is generating a substantially random modulating signal for use in modulating the probe signal. The modulation can be either analog or digital; in the latter case it would be a random sequence of ones and zeroes.

The system also includes a modulator that is responsive to the random modulating signal, for the purpose of applying the modulating signal to the probe signal to produce a modulated probe signal. The modulated probe signal is in this way made to fluctuate substantially in accordance with the random modulating signal.

The system also includes at least one intrusion sensor. One purpose of the sensor(s) is to establish at least a "secure" condition and an "alarm" condition of the subject facility. As will be seen, the most effective systems provided in accordance with our invention have intrusion sensors that establish more than these two conditions.

Another purpose of the sensor(s) is to receive the modulated probe signal and impress information as to the secure or alarm condition—or any other condition which the sensor(s) can establish—upon the modulated probe signal, to form a composite reply signal.

The system also includes a signal receiver for receiving the composite reply signal. The signal sources and modulator are not to be in the same location(s) as the intrusion sensor(s), and the latter will not be in the same location as the signal receiver. Therefore the system also includes a first signal path for carrying the modulated probe signal to the intrusion sensor—and a second signal path for carrying the composite reply signal from the intrusion sensor to the signal receiver.

It is possible for an intruder, of course, to be completely unaware of even the existence of any security system, and therefore to simply break into the subject facility It is also possible for the signal paths, and the signals carried by them, to be interrupted—either in the course of such a break-in or otherwise. Our system therefore includes an alarm device that is responsive to the composite reply signal at the signal receiver. This alarm device generates an alarm signal if and only if (a) the composite reply signal has impressed upon it information that the facility is in its alarm condition or (b) the reply signal is interrupted entirely.

The system also includes a correlation-testing device that is responsive to both the modulation of the modulating signal and the modulation of the composite reply signal as the latter appears at the signal receiver. The correlation-testing device intercompares the modulations of these two signals, and generates an attempted-deception signal when the relationship between these two is not "what it should be."

That is to say, "deception" is signalled when the composite-reply-signal modulation is not correlated with the modulating-signal modulation in a particular manner.

Various "particular manners" that we consider advantageous are discussed in the detailed description that follows. All of the foregoing operational principles and advantages of the present invention will be more fully appreciated upon consideration of the following detailed description, with reference to the appended drawings, of which:

BRIEF DESCRIPTION OF THE DRAWINGS

(FIGS. 1 and 3 both illustrate use of the invention with one of many possible "passive" sensors—here a magnetic switch.)

(FIG. 4 illustrates use of the invention with one of many possible "active" sensors—here an ultrasonic motion sensor.)

DETAILED DESCRIPTION OF PREFERRED EMBODIMENTS

Figure 1:
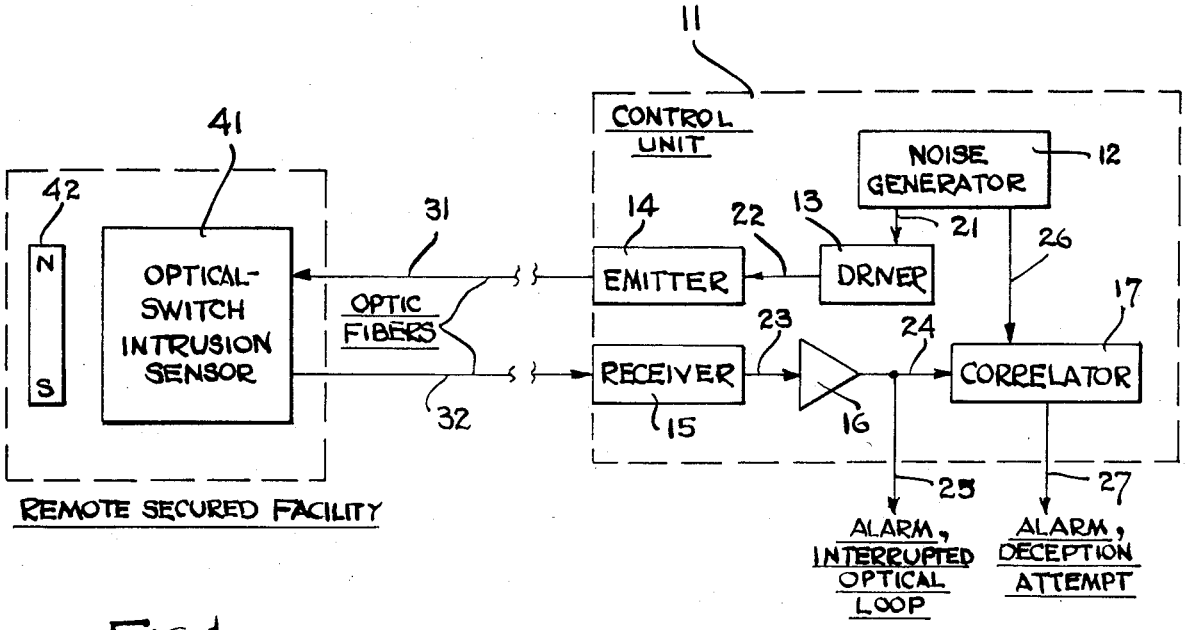
FIG. 1 is a block diagram of a security system that is one preferred embodiment of our invention.

As shown in FIG. 1, a preferred embodiment of our invention includes a control unit 11, which in turn includes a radiation emitter 14, a driver 13 which supplies variable power as at 22 to the emitter 14, and a noise generator 12. The noise generator supplies a substantially random controlling signal as at 21 to the driver 13. Without descending into intricate discussion of the merits of various levels of randomness, let it suffice to say that a modulating signal will be adequately (and thus "substantially") random for the purposes at hand if there is no practical way for a would-be intruder *who knows exactly how the system is made* to predict the signal at a particular moment.

By this combination of elements the driver 13 is made to supply variable power, as at 22, which is modulated or varied in accordance with the substantially random controlling signal at 21.

The controlling signal at 21 corresponds, in this embodiment to the modulating signal mentioned earlier; and the driver output power at 22 is the modulated probe signal, starting along the probe-signal path. The emitter 14 is part of the first signal *path* as previously defined, merely converting the already-modulated probe signal from electrical form along electrical connections at 22 to optical (or other radiative) form along an optic fiber (or other radiation waveguide) at 31.

The probe-signal path terminates at a remote optical-switch (or other) intrusion sensor 41, which may be controlled by proximity of a magnet 42. The term "remote" as used in certain parts of this document encompasses short distances of a few feet or even inches from a monitoring device to the subject facility, as well as distances of many miles. The sensor 41 establishes at least either a "secure" or an "alarm" condition, and transmits a reply signal along optic fiber (or other radiation waveguide) 32, to a receiver 15. The receiver 15 responds to the radiative signal at 32 by generating a corresponding electrical signal 23.

After buffering and amplification in an amplifier 16, the reply signal 24 is applied to a correlator 17, which evaluates the correlation between the the reply signal 24 and a reference signal 26 from the noise generator 12. The radiative and electrical signals 32, 23 and 24 may all be regarded as the reply signal at the receiver 15, being merely three signals that carry the same information in different forms.

The reference signal 26 is generated in such a way as to convey sufficient information about the instantaneous state of the random modulating signal 21 to permit the correlator 17 to, in effect, evaluate the correlation between the modulation of the modulating signal 21 and the modulation of the reply signal 24. If desired, in fact, the reference signal 26 and modulating signal 21 may be identical—and indeed may be taken from a common circuit point.

If preferred, however, the reference signal 26 may be quite different in form from the modulating signal 21, so long as the reference signal conveys the requisite information. Alternatively, the reference signal 26 may be derived within the driver 13; or may be formed as the variable power signal 22, or from that signal; or may even be formed by splitting the radiation beam from the emitter and intercepting some of the radiation at an auxiliary optical receiver. Based on the foregoing it is intended to be clear that these are all ways of deriving a suitable modulation-state reference signal for application to the correlator 17, for comparative purposes.

Stated more generally, there are generally three ways in which the correlator can be made responsive to the modulation of the modulating signal: a signal may be derived from the same device or source that is used to produce the modulating signal, and that is therefore systematically related to the modulating signal; or a signal may be derived from the modulating signal itself; or a signal may be derived from the modulated probe signal.

The third of these approaches—making the correlation-testing device responsive to the modulating signal in the form of the modulated probe signal—is possibly the best, especially if the modulated probe signal is available in electrical form as at 22 in FIG. 1.

If the intrusion sensor 41 establishes an "alarm" condition and transmits it along the reply-signal path 32, the amplifier 16 will produce an "alarm" signal 24. The same result will obtain if either signal path 31 or 32 is interrupted. In either case the "alarm" signal 24 will appear as an "alarm" output, as at 25.

If, however, neither the secured facility nor the signal path is actually breached but there is an inadequate deception attempt—that is, an attempt is made to substitute a reply signal and the simulated reply signal is not correlated with the modulating signal in a particular manner—then the correlator 17 will generate a different kind of "alarm" output as at 27.

Several types of "particular manner" are feasible. To consider the simplest example, the "particular manner"

required by the correlation-testing device may be a positive correlation between the two signals. For instance, if the signals are both digital, either they must both be "high" ("one") or they must both be "low" ("zero"). The correlation-testing device in this case is simply an "XOR" (exclusive-OR) gate.

The task of the intruder now, even with this simplest embodiment of our invention, has been inflated enormously. The intruder must now:

(1) know how the system works, and
(2) make a tap on each signal path and determine which is which (it is no longer a feasible alternative to inject the same signal into both paths, for the signal in one path must be read continuously to determine the instantaneously appropriate signal to be injected into the other path), and
(3) extract sufficient energy from the probe path to control the injection apparatus, and
(4) provide a "repeater" apparatus that responds to the expectably low extracted energy from the probe path and generates a corresponding simulated reply signal that has sufficient energy to deceive the signal receiver and correlation-testing device, and
(5) make the tap on the reply path suitable for use as a signal-injection point, and
(6) couple enough of the energy from the repeater into the injection tap to deceive the receiver and correlation tester.

Figure 2:
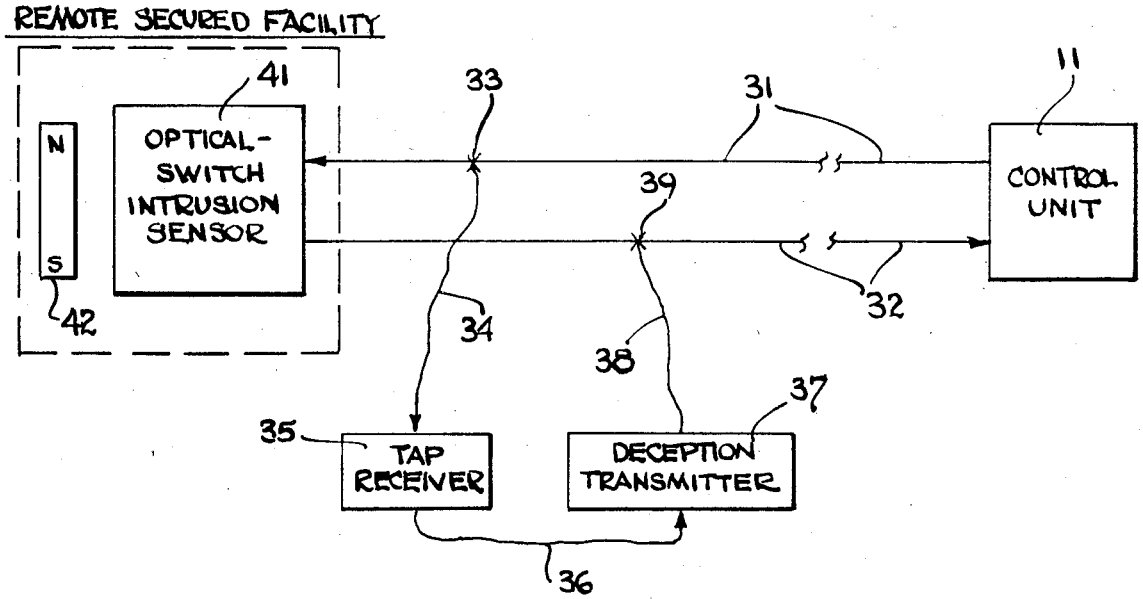
FIG. 2 is a similar block diagram showing the equipment that must be used by a would-be intruder to defeat the security system of FIG. 1.

FIG. 2 shows the same system as FIG. 1, with the addition of equipment that must be somehow unobtrusively installed by a would-be intruder, to defeat the system of our invention. The intruder must first make radiation output taps at 33 and 39, and determine which of the two taps is exposed to the probe signal and which is exposed to the reply signal. This determination alone may be rather difficult, since the information content of the two signals may be identical, or even if different may yield no clues as to which is which; and since directionality of a radiation signal along a waveguide, at a single tap made under field conditions, is not apparent.

The would-be intruder must next install a receiver 35 to receive radiation signals along interception path 34 from the probe-signal tap 33, and a deception transmitter 37 to inject radiation signals along injection path 38 to the reply-signal tap 39. The receiver 35 and transmitter 37 must be interconnected at 36 in such a way that the deception transmitter 37 instantaneously simulates the correct reply signal—that is, the reply signal which the intrusion sensor 41 normally generates in response to the probe signal.

From step (4) as listed previously, and the foregoing discussion of FIG. 2, it may be seen that the intruder has been *forced* to rely on an analog of the "shorting" technique, since there is virtually no other way to provide the modulation information instantaneously in the simulated reply signal. The intruder can no longer "work around" the difficulty of "shorting" in the optical-signal context. As already explained, however, the "shorting" technique is almost prohibitively difficult in the context of optical-fiber signals or other intrinsically guarded signal transmission links.

The repeater must be an exceedingly sophisticated piece of equipment, very sensitive to the low energy extracted from the probe and capable of emitting relatively high energy into the reply path. At the same time since it must in general be brought to the intruder's worksite secretly, it must be compact and light.

These onerous constraints can be further compounded, to further weight down the intruder's shoulders, by two refinements: in the refined embodiment of our invention the first signal path carries the modulated probe signal at a *very* low modulation amplitude—sufficiently low to significantly deter accurate detection of the modulating signal; and the second signal path carries the composite reply signal with *very* high total power—sufficiently high to significantly deter substitution of a deception signal by an intruder under field conditions.

If preferred, either of these refinements can be provided without the other.

The intruder's job may be made even more difficult by configuring the receiver 15 and amplifier 16 to generate an alarm 25 if the reply signal 32 or 23 is not within a narrow range of correct amplitudes. Thus the deception transmitter cannot be brought into operation—superimposing the deception signal 38 upon the normal reply signal—without triggering an alarm.

This constraint requires the intruder to somehow bring the deception transmitter 37 into operation simultaneously with the interruption of the *normal* signal path between points 33 and 39—within a particular number of milliseconds or microseconds, established by the response time of the receiver 15 and amplifier 16. The intruder presumably could do this only by automatically monitoring the normal reply signal at tap 39 (or a parallel tap), and automatically switching on the deception transmitter 37 as soon as the normal reply signal ceases. The intruder's equipment is thus made even more complex, unreliable, and bulky.

Returning to the "particular manner" of correlation required by the correlation testing device: such a "particular manner" need *not* necessarily be simply a positive correlation, for the system may be made in such a way as to generate deception signals if the correlation is not:

(a) negative, or
(b) sometimes negative and sometimes positive, according to a predetermined pattern, or
(c) sometimes negative and sometimes positive, according to another signal that is generated at the location of the signal sources and modulator and transmitted with the probe signal, or
(d) sometimes negative and sometimes positive, according to another signal that is generated at the intrusion sensor and transmitted only with the reply signal, or
(e) sometimes negative and sometimes positive, according to another signal that is generated in response to external conditions such as lighting, humidity, temperature, ambient sound, etc., or
(f) varying in a probably infinite number of other complex ways—including the use of some particular way(s) at certain times and other way(s) at other times.

With respect to possibility number (d), the other signal generated at the intrusion sensor may also be substantially random, making even more difficult the would-be intruder's task of determining what the proper signal level is to be.

If it be assumed that the would-be intruder knows how the system is made and how it works, the result of even dual-random modulation as suggested in the preceding paragraph is not to make the intrusion impossible, but rather to make it *extremely* difficult—since the intruder now must:

(1) know how the system works, and (2) tap each signal path and determine which is which, and
(3) extract the primary random modulation from the probe-signal path, and
(4) provide the necessary repeater as already described, but *in addition* either (a) breach the secure facility without disturbing the operation of the secondary random modulator, or (b) build into his own "repeater" unit a secondary random modulator, correlation-revising apparatus, and equipment for signalling the status of the secondary random modulator to the correlation-testing device via the reply path, and
(5) tap the reply-signal path for signal injection, and
(6) inject the simulated reply signal into the reply path.

New alternative (4)(a) can probably be made impossible, and alternative (4)(b) adds yet further to the complexity, bulkiness and weight of the intruder's backpack.

The signal receiver and/or correlation-testing device need not be in the same location as the signal sources and modulator, but information about the modulation must be provided to the correlation-testing device in some suitable way.

If an intruder *cannot* satisfy point (1) above, then even a system in accordance with our invention and utilizing *ordinary electrical wires* for the signal paths will be very effective, provided only that some correlation other than simple, constant positive correlation (to defeat a simple short) is used.

If an intruder *does* know how the system works, however, then it is preferable to use some type of transmission link that is intrinsically more guarded. Certain forms of electromagnetic-radiation signals are appropriate for this purpose. Such signals at radio frequencies may be appropriate if they are capable of "confinement," to a very high degree of isolation, within some sort of waveguide that cannot be readily breached without detection.

Perhaps the ideal electromagnetic-radiation signals for the purpose are at optical frequencies—that is to say, are light signals. For such optical signals the appropriate waveguides are optic fibers. Such fibers, as already suggested by the foregoing discussion, are not readily breached without detection, and are indeed capable of confining the transmitted light signals to a very high degree of isolation; yet they are relatively lightweight, durable, inexpensive, efficient and reliable.

Figure 3:
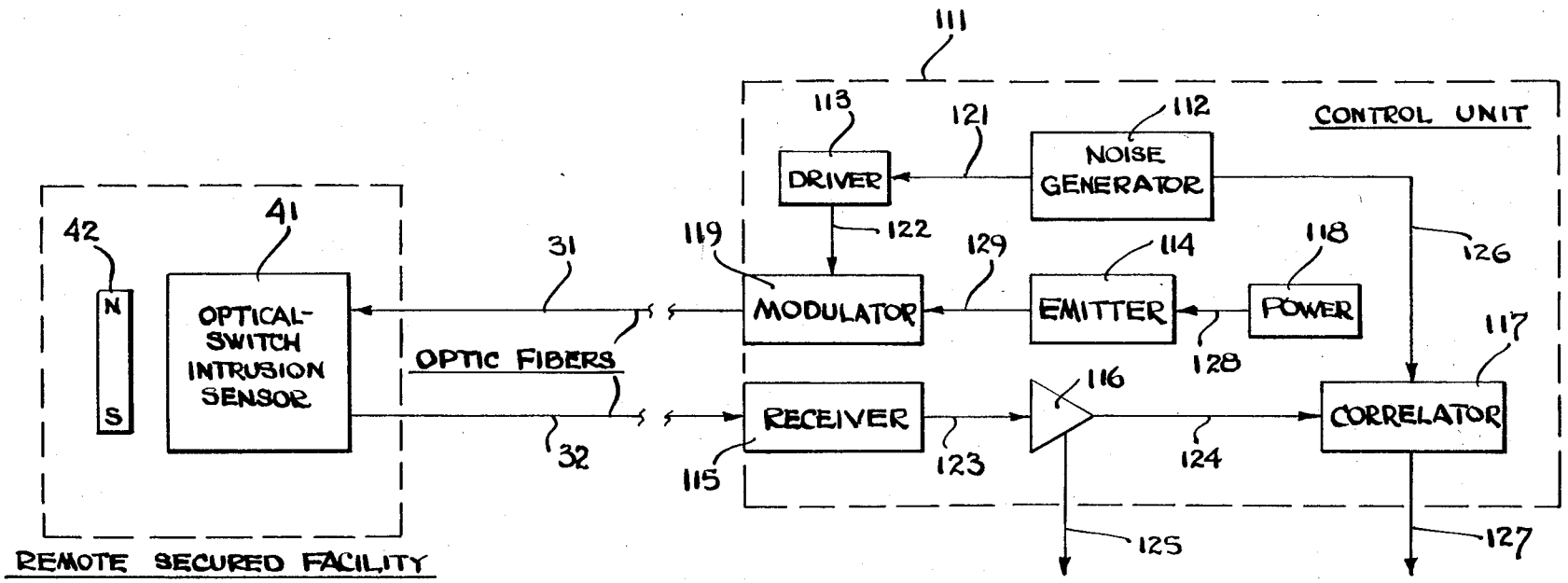
FIG. 3 is a partial block diagram showing a variant of the FIG. 1 system.

FIG. 3 illustrates a control unit 111 in which the modulated radiation signal at 31 is developed in a somewhat different way from that developed in the FIG. 1 apparatus.

The variant system of FIG. 3 may be understood as follows. There are at least two conceptually distinct ways in which a light beam presented to an optic fiber can be modulated: the light source itself may be supplied with modulated power, or the light from the source may be passed through an optical modulator The latter may be an electrically controllable dichroic device or other optically active component that is arranged to vary the intensity, polarization, transmitted wavelength, "chopping" frequency, or other parameter of the light beam.

Stated more generally, these two alternatives are:
(1) the first signal path includes an electromagnetic-radiation emitter that receives a variable electrical input signal and emits a correspondingly variable electromagnetic-radiation signal, and the modulating signal is applied to vary the variable electrical input signal; or
(2) the probe-signal emitter includes an electromagnetic-radiation source that emits an electromagnetic-radiation signal, and the modulating signal is applied to an electronically controllable device that modulates the electromagnetic-radiation signal from the electromagnetic-radiation source.

Thus the variant control unit 111 of FIG. 3 includes a radiation emitter 114 similar to the emitter 14 of FIG. 1, a noise generator 112 similar to the noise generator 12 of FIG. 1, and a driver 113 similar to the driver 13 of FIG. 1. As in FIG. 1, the noise generator 112 supplies a signal 121 to control the driver 113, and the driver 113 supplies a modulating signal 122.

Here, however, the radiation emitter 114 is energized at 128 by a constant-amplitude power source 118, so that the radiation signal 129 from the emitter 114 is essentially constant for present purposes—that is, it is unmodulated so far as modulation for security purposes is concerned, though it may be an a.c. signal or may be otherwise modulated for other purposes (such as information transmission).

Modulation for security purposes is here accomplished by an electronically controlled radiation modulator 119, which receives the radiation beam 129 from the emitter 114 and which receives the modulating signal 122 from the driver 113. If the emitter 114 and beam 129 are optical, for example, the modulator 119 may for example be an electrooptical modulator, such as a dichroic device, capable of responding to its two inputs by generating an optical output signal at 31 whose amplitude or other parameter(s) will vary in accordance with the modulating signal 122.

The remainder of the variant control unit 111 is essentially the same as the control unit 11 previously discussed, making suitable allowances in the equipment such as receiver 115, amplifier 116 and correlator 117, to accommodate differences in the electrical signals 126, 123 and 124, and the radiation signals 31 and 32, that are to be produced and processed.

In this FIG. 3 embodiment, the driver output signal at 122 may be regarded as a form of the modulating signal— rather than being regarded as the modulated probe signal, as is the driver output at 22 in FIG. 1. In FIG. 3 the modulated probe signal first appears as the radiation signal in the waveguide 31. The power supply 118 and radiation emitter 114 may be regarded as part of the "probe-signal source" mentioned earlier, rather than part of the "first signal path" as is the emitter 14 of FIG. 1.

Figure 4:
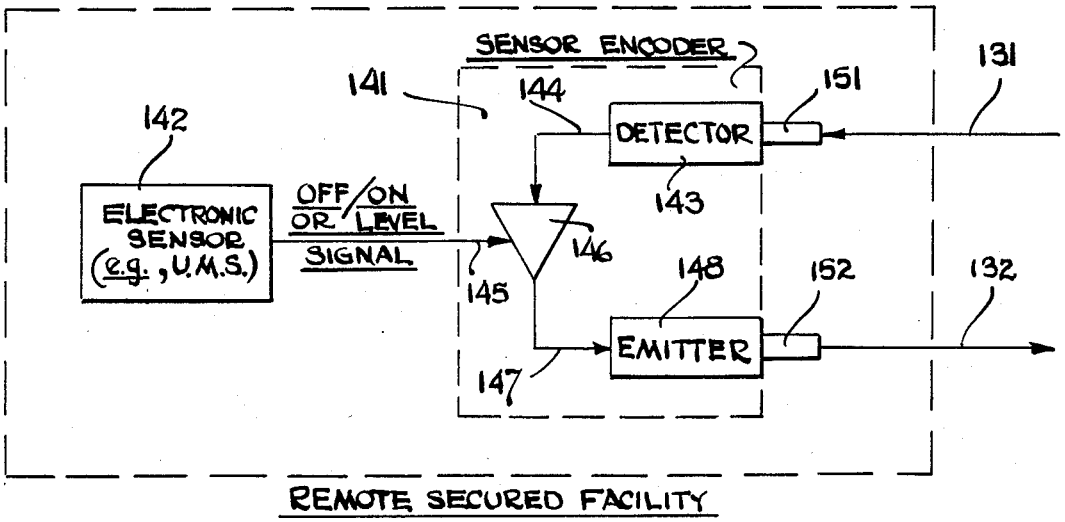
FIG. 4 is another partial block diagram showing another variant of the FIG. 1 system.

FIGS. 1 through 3 suggest that an intrusion sensor of a relatively simple "on/off" or "secure"/"alarm" type is to be used with the system. As shown in FIG. 4, however, the sensor may be substantially more elaborate. FIG. 4 shows a combination sensor assembly which includes an electronic sensor 142 such as a motion sensor, and a sensor encoder 141 that encodes information from the electronic sensor 142 for transmission to the control unit 11 (FIG. 1) or 111 (FIG. 3). As an example, the sensor 142 may be an ultrasonic motion sensor. The electronic sensor 142 may itself generate a simple on/off signal, or may generate an analog or digitized version of a "*level*" signal—indicating, for instance, the amplitude or proximity of sensed motion, or of sensed sound. The electronic sensor's output signal 145 is applied to control some parameter of a variable amplifier 146 in the encoder section 141.

This amplifier 146 receives an electrical input signal 144 that corresponds to the radiation signal 131—by virtue of a waveguide connector 151 and a radiation detector 143. The output signal 147 of the variable amplifier 146 thus consists of an electrical signal corresponding to the input signal 144—but controlled, as to some parameter, by the electronic sensor's output signal 145. This composite signal is applied to power a radiation emitter 148, which is coupled at an output connector 152 to the reply-signal waveguide 132. The reply-signal radiation at 132 then carries a composite of (1) the modulation information in the probe-signal radiation path 131 and (2) the variable-level information in the electronic-sensor output signal 145.

Instead, or in addition, the variable amplifier 146 may be made to inject yet other kinds of information into the reply-signal electrical version at 147 and radiation version at 132.

For instance, the amplifier 146 may generate and superimpose a correlation-polarity keying signal, and may at various times change this keying signal between "direct" and "reversed"—simultaneously reversing the polarity of the modulation of the signal passing through it from its input path 144 to its output path 147. The correlation-polarity keying signal should be detectable at the receiver 15, amplifier 16, and/or correlator 17 of FIG. 1 (or the corresponding components 115, 116 and/or 117 of FIG. 2), to control the correlator 17 (or 117) accordingly.

The correlation polarity, and its keying signal to the correlator 17 (or 117), can be reversed by the amplifier 146 at predetermined times. Alternatively, it can be reversed in accordance with some characteristics of signals that are received with the input electrical signal 144, or in accordance with signals generated locally at the sensor 142 or at the encoder 141. Such locally generated signals could be, for example, controlled by ambient conditions such as humidity, temperature, or light; or could be generated at random by another random-noise generator within the amplifier 146.

Figure 5:
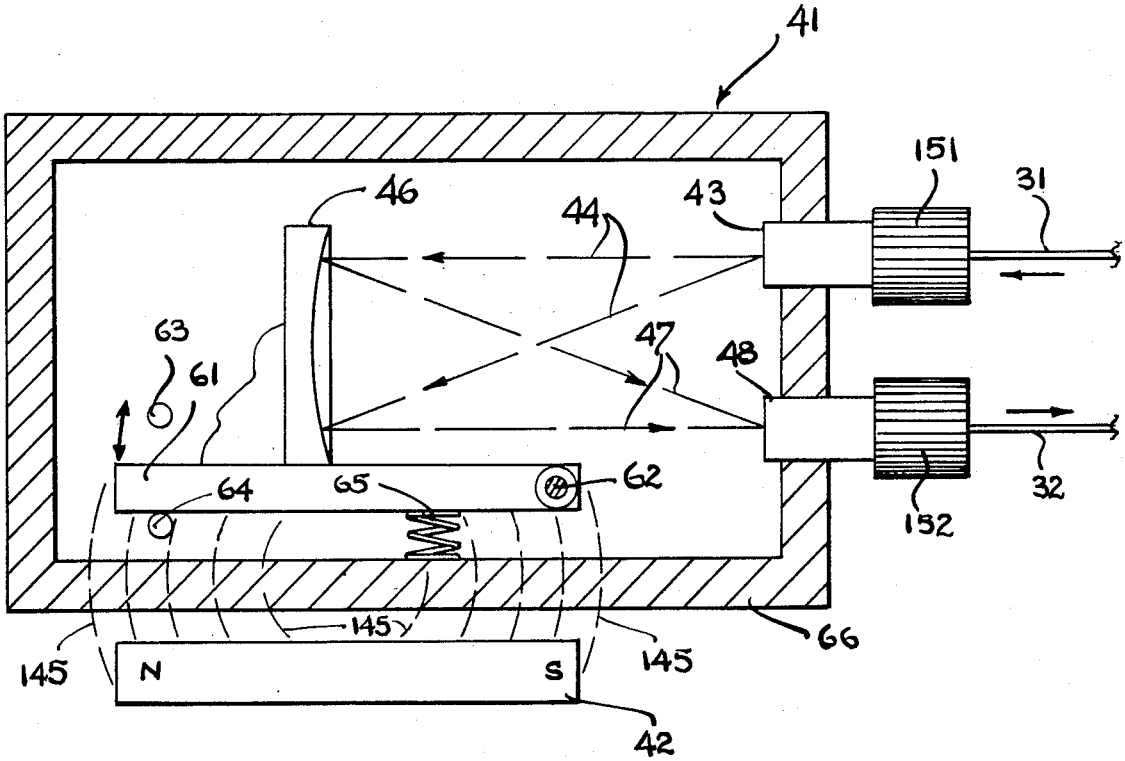
FIG. 5 is a generalized mechanical diagram showing an optical-switch intrusion sensor that may be used in the systems of FIGS. 1 through 3.

If it is not desired to use a relatively elaborate sensor assembly such as is shown in FIG. 4, however, it is possible to substitute a relatively simple "optical-switch" type, such as is shown in FIG. 5. This drawing may be understood as illustrating optical-fiber probe-signal and reply-signal paths 31 and 32, with optical-fiber connectors 151 and 152 mounted in a housing 66 and terminated in optical faces 43 and 48. From face 43 of input connector 151 an optical beam 44 diverges to mirror 46, and is there reflected as optical beam 47 to face 48 of output connector 152.

More generally, as elsewhere in this document, the device of FIG. 5 may be understood as a "radiation-switch" type if the signal paths and other components are adapted for nonoptical radiation.

In either case, advantageously the mirror 46 is mounted to support block 61, which is made of magnetic material and is rotatably secured at pivot pin 62 to the back and/or front walls of the housing 66. The housing is made of nonmagnetic materials. The support block 61 is rotatable about the pin 62 and is thereby adapted to swing up and down (as drawn) between stop pins 63 and 64. The block is also spring-loaded, as at 65, upward (away from the illustrated position) so as to position the mirror 46 for deflection of the reflected beam 47 *away from* the output-connector face 48. Thus, in the absence of other forces, the illustrated transmission of the radiation beam from the probe-signal path 31 to the reply-signal path 32 is interrupted.

Proximity of a magnet 42, however, to the outside of the nonmagnetic housing 66 adjacent the support block 61 will operate by means of magnetic force lines 145 to overcome the spring biasing force and thereby snap the mirror 46 into the position illustrated in FIG. 5. The magnetic poles are designated "N" and "S" in the drawing, as is conventional. In this position the probe-signal path 31 is directly coupled to the reply-signal path 32 as illustrated.

The housing 66 may be positioned on or in a door jamb, for example, and the magnet 42 may be positioned on or in the corresponding door—or vice versa—in such a way as to couple the two paths together optically when the door is closed, but not when it is open. Thus the mirror is moved into one position, in which it reflects an optical signal from the first signal path into the second signal path, if and only if the facility is in the "secure" condition.

More generally, the mirror is moved into position to reflect the signal from the first into the second path if and only if the facility is in *a particular one* of *either* the secure and the alarm conditions. We prefer, however, to use the secure condition, as otherwise it is necessary to make separate provision for determining when the optic-fiber signal path has been broken.

A great number of other intrusion sensors may be utilized with our invention—including that described in U.S. Pat. No. 4,367,460 to Hodara.

We claim:

1. An alarm system for a facility whose security is to be monitored, said system comprising:

a probe-signal source for generating a probe signal;

a modulating-signal source for generating a substantially random modulating signal for use in modulating the probe signal;

a modulator, responsive to the random modulating signal, for applying the modulating signal to the probe signal to produce a modulated probe signal that fluctuates substantially in accordance with the random modulating signal;

an intrusion sensor that establishes at least a secure condition and an alarm condition of such a facility, and that receives the modulated probe signal and impresses information as to the source or alarm condition upon the modulated probe signal, to form a composite reply signal;

a signal receiver for receiving the composite reply signal;

a first signal path for carrying the modulated probe signal to the intrusion sensor;

a second signal path for carrying the composite reply signal from the intrusion sensor to the signal receiver; and a correlation-testing device that is responsive to the mddulation of the modulating signal, and that is also responsive to the modulation of the composite reply signal at the signal receiver, and that compares the modulation of the composite reply signal with the modulation of the modulating signal, and that generates an attempted-deception signal when the composite-reply-signal modulation is not correlated with the modulating-signal modulation in a particular manner; and wherein:

the signals in at least part of the first signal path and in at least part of the second signal path are optical signals; and the intrusion sensor comprises an optical mirror that is moved into position to reflect an optical signal from the first signal path into the second signal path if and only if the facility is in a particular one of the secure and alarm conditions.

2. The system of claim 1 wherein:

the optical paths comprise optic fibers that carry the optical signals.

3. An alarm system for a facility whose security is to be monitored, said system comprising:

a probe-signal source for generating a probe signal;

a modulating-signal source for generating a substantially random modulating signal for use in modulating the probe signal;

a modulator, responsive to the random modulating signal, for applying the modulating signal to the probe signal to produce a modulated probe signal that fluctuates substantially in accordance with the random modulating signal;

an intrusion sensor that establishes at least a secure condition and an alarm condition of such a facility, and that receives the modulated probe signal and impresses information as to the secure or alarm condition upon the modulated probe signal, to form a composite reply signal;

a signal receiver for receiving the composite reply signal;

a first signal path for carrying the modulated probe signal to the intrusion sensor;

a second signal path for carrying the composite reply signal from the intrusion sensor to the signal receiver; and a correlation-testing device that is responsive to the modulation of the modulating signal, and that is also responsive to the modulation of the composite reply signal at the signal receiver, and that compares the modulation of the composite reply signal with the modulation of the modulating signal, and that generates an attempted-deception signal when the composite-reply-signal modulation is not correlated with the modulating-signal modulation in a particular manner; and wherein:

the first signal path carries the modulated probe signal at a modulation amplitude that is sufficiently low to significantly deter accurate detection of the modulating signal.

4. An alarm system for a facility whose security is to be monitored, said system comprising:

a probe-signal source for generating a probe signal;

a modulating-signal source for generating a substantially random modulating signal for use in modulating the probe signal;

a modulator, responsive to the random modulating signal, for applying the modulating signal to the probe signal to produce a modulated probe signal that fluctuates substantially in accordance with the random modulating signal;

an intrusion sensor that establishes at least a secure condition and an alarm condition of such a facility, and that receives the modulated probe signal and impresses information as to the secure or alarm condition upon the modulated probe signal, to form a composite reply signal;

a signal receiver for receiving the composite reply signal;

a first signal path for carrying the modulated probe signal to the intrusion sensor;

a second signal path for carrying the composite reply signal from the intrusion sensor to the signal receiver; and a correlation-testing device that is responsive to the modulation of the modulating signal, and that is also responsive to the modulation of the composite reply signal at the signal receiver, and that compares the modulation of the composite reply signal with the modulation of the modulating signal, and that generates an attempted-deception signal when the composite-reply-signal modulation is not correlated with the modulating-signal modulation in a particular manner; and wherein:

the second signal path carries the composite reply signal with total power that is sufficiently high to significantly deter substitution of a deception signal by an intruder under field conditions.

5. An alarm system for a facility whose security is to be monitored, said system comprising:

a probe-signal source for generating a probe signal;

a modulating-signal source for generating a substantially random modulating signal for use in modulating the probe signal;

a modulator, responsive to the random modulating signal, for applying the modulating signal to the probe signal to produce a modulated probe signal that fluctuates substantially in accordance with the random modulating signal;

an intrusion sensor that establishes at least a secure condition and an alarm condition of such a facility, and that receives the modulated probe signal and impresses information as to the secure or alarm condition upon the modulated probe signal, to form a composite reply signal;

a signal receiver for receiving the composite reply signal;

signal-path means for carrying the modulated probe signal to the intrusion sensor and for carrying the composite reply signal from the intrusion sensor to the signal receiver; and a correlation-testing device that is responsive to the modulation of the modulating signal, and that is also responsive to the modulation of the composite reply signal at the signal receiver, and that compares the modulation of the composite reply signal with the modulation of the modulating signal, and that generates an attempted-deception signal when the composite-reply-signal modulation is not correlated with the modulating-signal modulation in a particular manner; and wherein:

the signals in at least part of the signal-path means are optical signals; and the intrusion sensor comprises an optical mirror that is moved into position to receive an optical signal exiting from the signal-path means and reflect that optical signal into the signal-path means if and only if the facility is in a particular one of the secure and alarm conditions.

6. The alarm system of claim 5, wherein:

the signal-path means comprise optic fiber means for carrying the optical signals.

7. An alarm system for a facility whose security is to be monitored, said system comprising:

a probe-signal source for generating a probe signal;

a modulating-signal source for generating a substantially random modulating signal for use in modulating the probe signal;

a modulator, responsive to the random modulating signal, for applying the modulating signal to the probe signal to produce a modulated probe signal that fluctuates substantially in accordance with the random modulating signal;

an intrusion sensor that establishes at least a secure condition and an alarm condition of such a facility, and that receives the modulated probe signal and impresses information as to the secure or alarm condition upon the modulated probe signal, to form a composite reply signal;

a signal receiver for receiving the composite reply signal;

signal-path means for carrying the modulated probe signal to the intrusion sensor and for carrying the composite reply signal from the intrusion sensor to the signal receiver; and a correlation-testing device that is responsive to the modulation of the modulating signal, and that is also responsive to the modulation of the composite reply signal at the signal receiver, and that compares the modulation of the composite reply signal with the modulation of the modulating signal, and that generates an attempted-deception signal when the composite-reply-signal modulation is not correlated with the modulating-signal modulation in a particular manner; and wherein:

the signal-path means carry the modulated probe signal at a modulation amplitude that is sufficiently low to significantly deter accurate detection of the modulating signal.

8. An alarm system for a facility whose security is to be monitored, said system comprising:

a probe-signal source for generating a probe signal;

a modulating-signal source for generating a substantially random modulating signal for use in modulating the probe signal;

a modulator, responsive to the random modulating signal, for applying the modulating signal to the probe signal to produce a modulated probe signal that fluctuates substantially in accordance with the random modulating signal;

an intrusion sensor that establishes at least a secure condition and an alarm condition of such a facility, and that receives the modulated probe signal and impresses information as to the secure or alarm condition upon the modulated probe signal, to form a composite reply signal;

a signal receiver for receiving the composite reply signal;

signal-path means for carrying the modulated probe signal to the intrusion sensor;

a second signal path for carrying the composite reply signal from the intrusion sensor to the signal receiver; and a correlation-testing device that is responsive to the modulation of the modulating signal, and that is also responsive to the modulation of the composite reply signal at the signal receiver, and that compares the modulation of the composite reply signal with the modulation of the modulating signal, and that generates an attempted-deception signal when the composite-reply-signal modulation is not correlated with the modulating-signal modulation in a particular manner; and wherein:

the signal-path means carry the composite reply signal with total power that is sufficiently high to significantly deter substitution of a deception signal by an intruder under field conditions.

* * * * *